US010654294B2

(12) United States Patent
Oguchi et al.

(10) Patent No.: US 10,654,294 B2
(45) Date of Patent: May 19, 2020

(54) PRINTING APPARATUS

(71) Applicant: FUJITSU COMPONENT LIMITED, Tokyo (JP)

(72) Inventors: Tatsuya Oguchi, Tokyo (JP); Sumio Watanabe, Tokyo (JP); Yukihiro Mori, Tokyo (JP)

(73) Assignee: FUJITSU COMPONENT LIMITED, Tokyo (JP)

( * ) Notice: Subject to any disclaimer, the term of this patent is extended or adjusted under 35 U.S.C. 154(b) by 0 days.

(21) Appl. No.: 16/190,366

(22) Filed: Nov. 14, 2018

(65) Prior Publication Data

US 2019/0176494 A1 Jun. 13, 2019

(30) Foreign Application Priority Data

Dec. 11, 2017 (JP) ..... 2017-237111

(51) Int. Cl.

| | |
|---|---|
| ***B41J 11/04*** | (2006.01) |
| ***B41J 29/02*** | (2006.01) |
| ***B41J 3/36*** | (2006.01) |
| ***B41J 11/00*** | (2006.01) |

(52) U.S. Cl.

CPC ..... *B41J 11/04* (2013.01); *B41J 3/36* (2013.01); *B41J 11/006* (2013.01); *B41J 29/023* (2013.01)

(58) Field of Classification Search

CPC ..... B41J 11/04; B41J 11/006; B41J 29/023; B41J 3/36

USPC ..... 347/104

See application file for complete search history.

(56) References Cited

U.S. PATENT DOCUMENTS

| | | | | |
|---|---|---|---|---|
| 6,121,990 | A * | 9/2000 | Fujiwara | B41J 13/00 347/222 |
| 6,238,043 | B1 * | 5/2001 | Silverbrook | B41J 2/01 347/86 |
| 6,416,160 | B1 | 7/2002 | Silverbrook | |
| 6,553,459 | B1 | 4/2003 | Silverbrook et al. | |
| 6,712,452 | B1 | 3/2004 | Silverbrook et al. | |
| 6,804,026 | B1 | 10/2004 | Walmsley | |
| 6,812,972 | B1 | 11/2004 | Silverbrook et al. | |
| 6,903,766 | B1 | 6/2005 | Silverbrook et al. | |
| 6,924,907 | B1 | 8/2005 | Silverbrook et al. | |
| 6,956,669 | B1 | 10/2005 | Silverbrook et al. | |
| 6,958,826 | B1 | 10/2005 | Walmsley et al. | |
| 6,967,741 | B1 | 11/2005 | Silverbrook et al. | |

(Continued)

FOREIGN PATENT DOCUMENTS

| | | |
|---|---|---|
| JP | H07-222223 | 8/1995 |
| JP | 2003-500245 | 1/2003 |

(Continued)

*Primary Examiner* — Huan H Tran
*Assistant Examiner* — Alexander D Shenderov
(74) *Attorney, Agent, or Firm* — IPUSA, PLLC

(57) ABSTRACT

A printing apparatus having a pillar shape includes a printing mechanism, a motor, and a gear box. The printing mechanism includes a print head configured to perform printing on a recording sheet and a platen roller configured to convey the recording sheet. The gear box is configured to transmit the rotation of the motor to the platen roller. The printing mechanism, the gear box, and the motor are arranged in order from a first side of the printing apparatus toward a second side of the printing apparatus in a longitudinal direction of the printing apparatus.

6 Claims, 19 Drawing Sheets

(56) References Cited

U.S. PATENT DOCUMENTS

| | | | | |
|---|---|---|---|---|
| 6,975,429 | B1 | 12/2005 | Walmsley et al. | |
| 7,259,889 | B1 | 8/2007 | Walmsley | |
| 2017/0080723 | A1* | 3/2017 | Nohara | B41J 11/04 |
| 2018/0288244 | A1 | 10/2018 | Oguchi et al. | |

FOREIGN PATENT DOCUMENTS

| | | |
|---|---|---|
| JP | 2018-167521 | 11/2018 |
| KR | 100709017 | 4/2007 |

* cited by examiner

PRINTING APPARATUS

CROSS-REFERENCE TO RELATED APPLICATION

The present application is based on and claims priority to Japanese patent application No. 2017-237111, filed on Dec. 11, 2017, the entire contents of which are incorporated herein by reference.

BACKGROUND OF THE INVENTION

1. Field of the Invention

The present invention relates to printing apparatuses.

2. Description of the Related Art

Conventional portable printers have a box shape and are relatively large, and are carried in a bag or the like. There is a demand for small portable printers that are easy to carry, and a variety of printers have been proposed. (See, for example, Japanese National Publication of International Patent Application No. 2003-500245 and Japanese Laid-open Patent Publication No. 7-222223.)

SUMMARY OF THE INVENTION

According to an aspect of the present invention, a printing apparatus having a pillar shape includes a printing mechanism, a motor, and a gear box. The printing mechanism includes a print head configured to perform printing on a recording sheet and a platen roller configured to convey the recording sheet. The gear box is configured to transmit the rotation of the motor to the platen roller. The printing mechanism, the gear box, and the motor are arranged in order from a first side of the printing apparatus toward a second side of the printing apparatus in a longitudinal direction of the printing apparatus.

DESCRIPTION OF THE EMBODIMENTS

Figure 1:
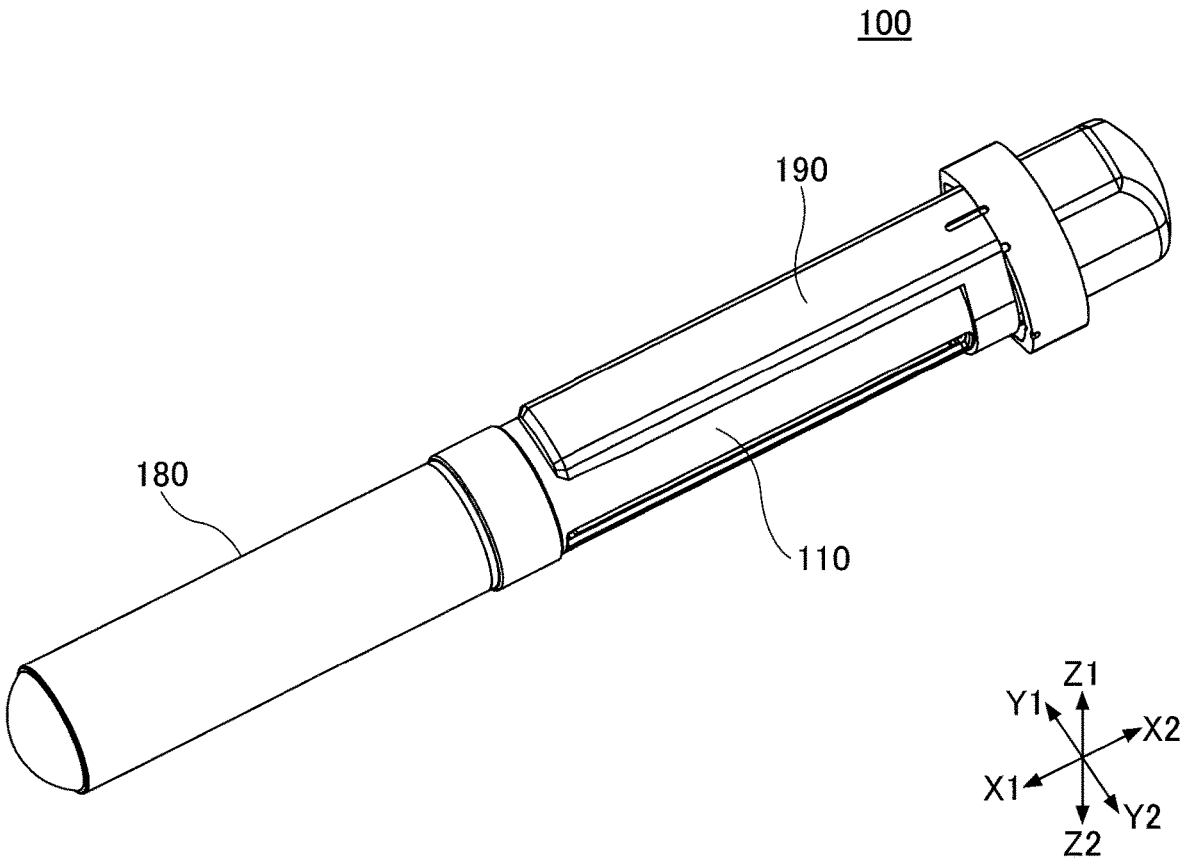
FIG. 1 is a perspective view of a printer according to an embodiment.

The printers of the proposed structures, however, are not sufficiently portable, and there is a demand for small, highly-portable printing apparatuses that are simpler and easier to carry.

According to an aspect of the present invention, it is possible to provide a small, highly-portable printing apparatus.

An embodiment is described below with reference to the accompanying drawings. In the following, the same members or the like are referred to using the same reference numeral, and duplicate description thereof is omitted. Furthermore, the embodiment is described using an XYZ coordinate system as defined as illustrated in the drawings. A direction along the X-axis is referred to as "X direction." A direction along the Y-axis is referred to as "Y direction." A direction along the Z-axis is referred to as "Z direction." The X direction, the Y direction, and the Z direction are orthogonal to one another. A plane including the X direction and the Y direction is referred to as "XY plane." A plane including the Y direction and the Z direction is referred to as "YZ plane." A plane including the Z direction and the X direction is referred to as "ZX plane."

A printing apparatus according to this embodiment prints information received from various information communicating apparatuses on a recording sheet.

Figure 2:
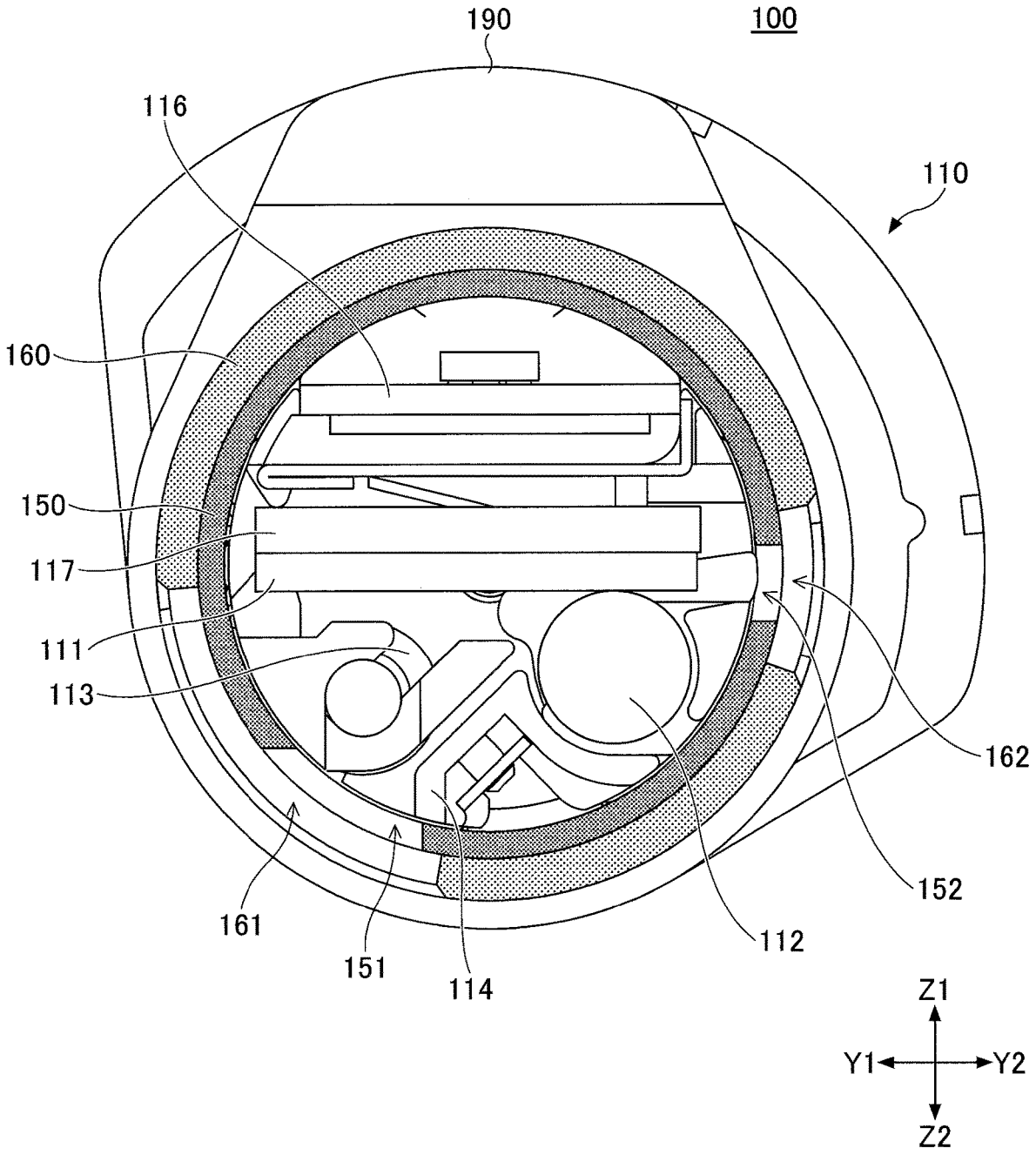
FIG. 2 is a cross-sectional view of the printer according to the embodiment.

A printer 100, which is the printing apparatus of this embodiment, is described with reference to FIGS. 1 and 2. FIGS. 1 and 2 are a perspective view and a cross-sectional view, respectively, of the printer 100. The printer 100, which has a pillar shape and has a cylindrical appearance, is an Internet of Things (IoT) apparatus including a printing function and a radio communication function.

The printer 100 includes a print unit 110. The print unit 110 includes a print head 111 such as a thermal head, a platen roller 112, a feed roller 113, a paper guide 114, a spring 119 (FIG. 7), a control board 116, an inner cover 150, and an outer cover 160. The print head 111 is pressed against the platen roller 212 via a heat sink 117 by the spring 119. A recording sheet is fed by the feed roller 113 to move into the printer 100 along the paper guide 114. The recording sheet is conveyed by the platen roller 112 while being held between the print head 111 and the platen roller 112, and is thereafter discharged. An electronic circuit and electronic components that control the printer 100 are mounted on the control board 116.

The inner cover 150 and the outer cover 160 are cylindrical, and the inner cover 150 is accommodated in the outer cover 160. The inner cover 150 includes an insert opening 151 and a discharge opening 152 that are open along the generatrix of the inner cover 150. The outer cover 160 includes an insert opening 161 and a discharge opening 162 that are open along the generatrix of the outer cover 160. The outer cover 160 is rotatable relative to the inner cover 150. When the printer 100 performs printing, the opening 151 and the opening 161 are aligned to be open, and the opening 152 and the opening 162 are aligned to be open. The recording sheet enters the printer 100 through the openings 151 and 161, and is discharged through the openings 152 and 162.

A cassette storing recording sheets can be connected to the opening 161 with the openings 151 and 161 being open. Print data are transmitted from an information apparatus to the printer 100 through radio communications using, for example, Bluetooth Low Energy (BLE). The printer 100 receives the print data and performs printing on a recording sheet.

A power supply 180 storing a lithium-ion battery, which is a rechargeable battery, is provided in the housing of the printer 100. The printer 100 can be driven with electric power supplied from the lithium-ion battery.

The printer 100, which is approximately 18 mm in diameter and approximately 165 mm to approximately 170 mm in length, is small and can be carried around without feeling stress. The printer 100 includes a hook 190 which allows the printer 100 to be put in the chest pocket of clothes to be carried around just like a pen.

Figure 3:
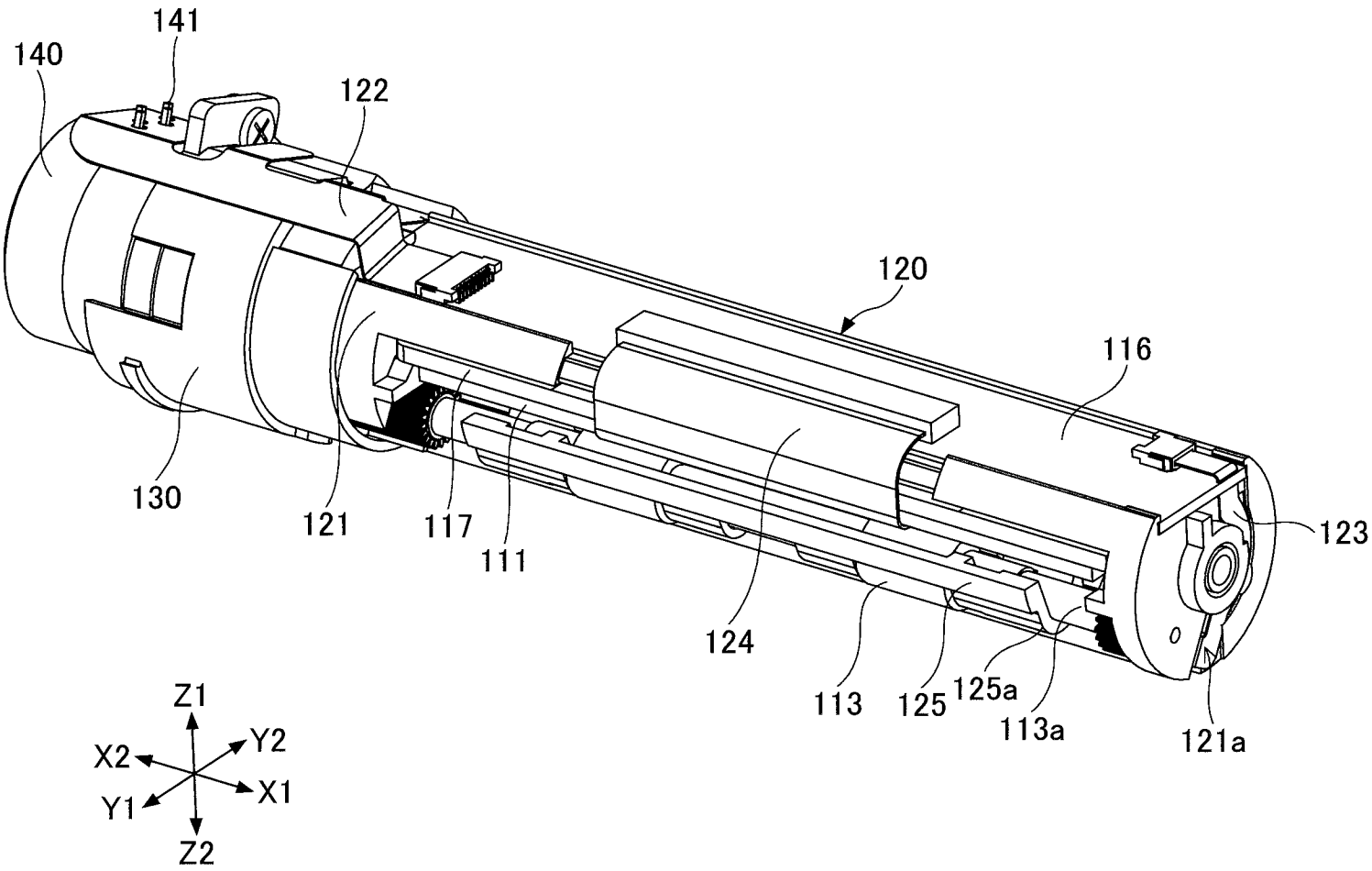
FIG. 3 is a perspective view of a printing mechanism according to the embodiment.
Figure 4:
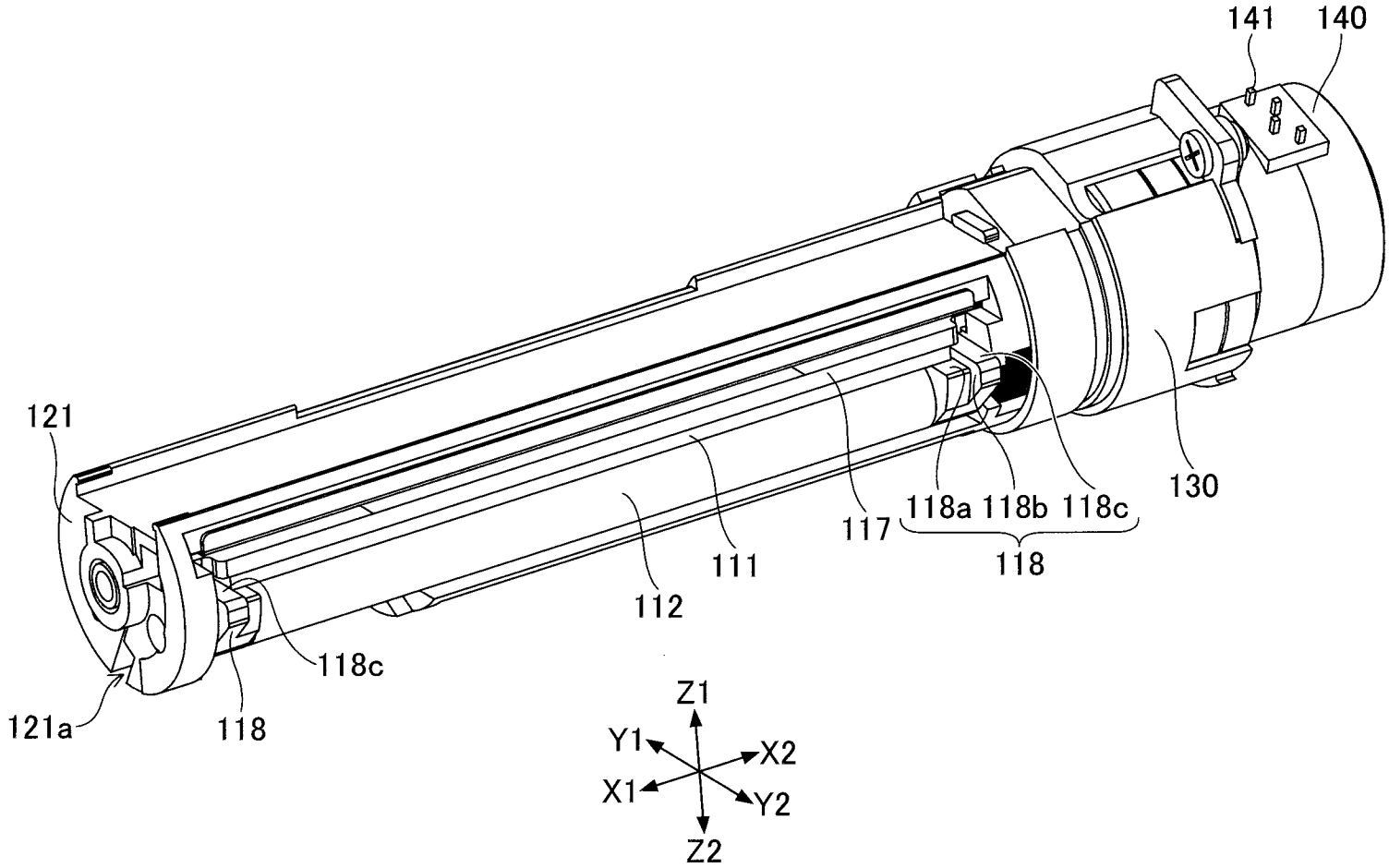
FIG. 4 is a perspective view of the printing mechanism according to the embodiment.
Figure 5:
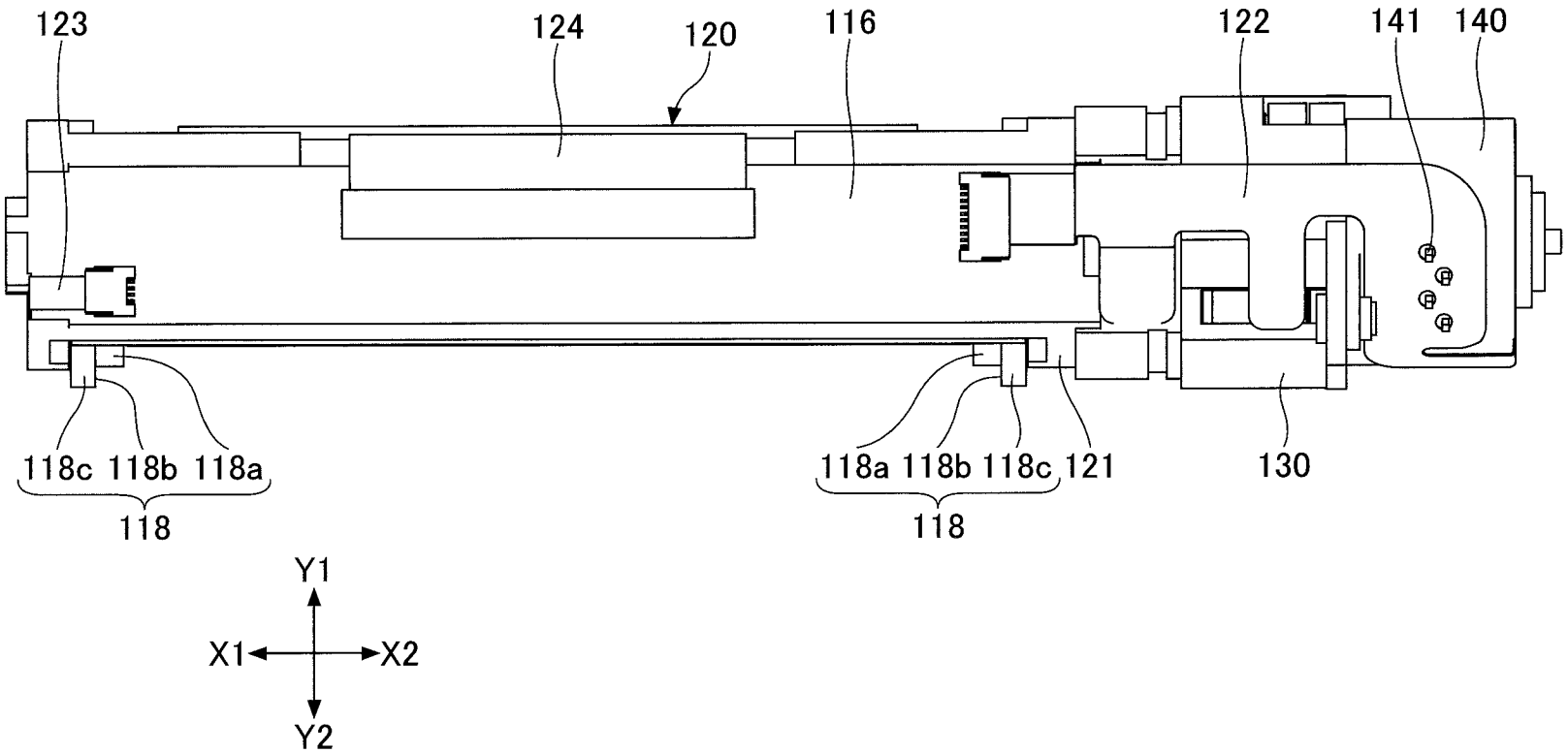
FIG. 5 is a top plan view of the printing mechanism according to the embodiment.
Figure 6:
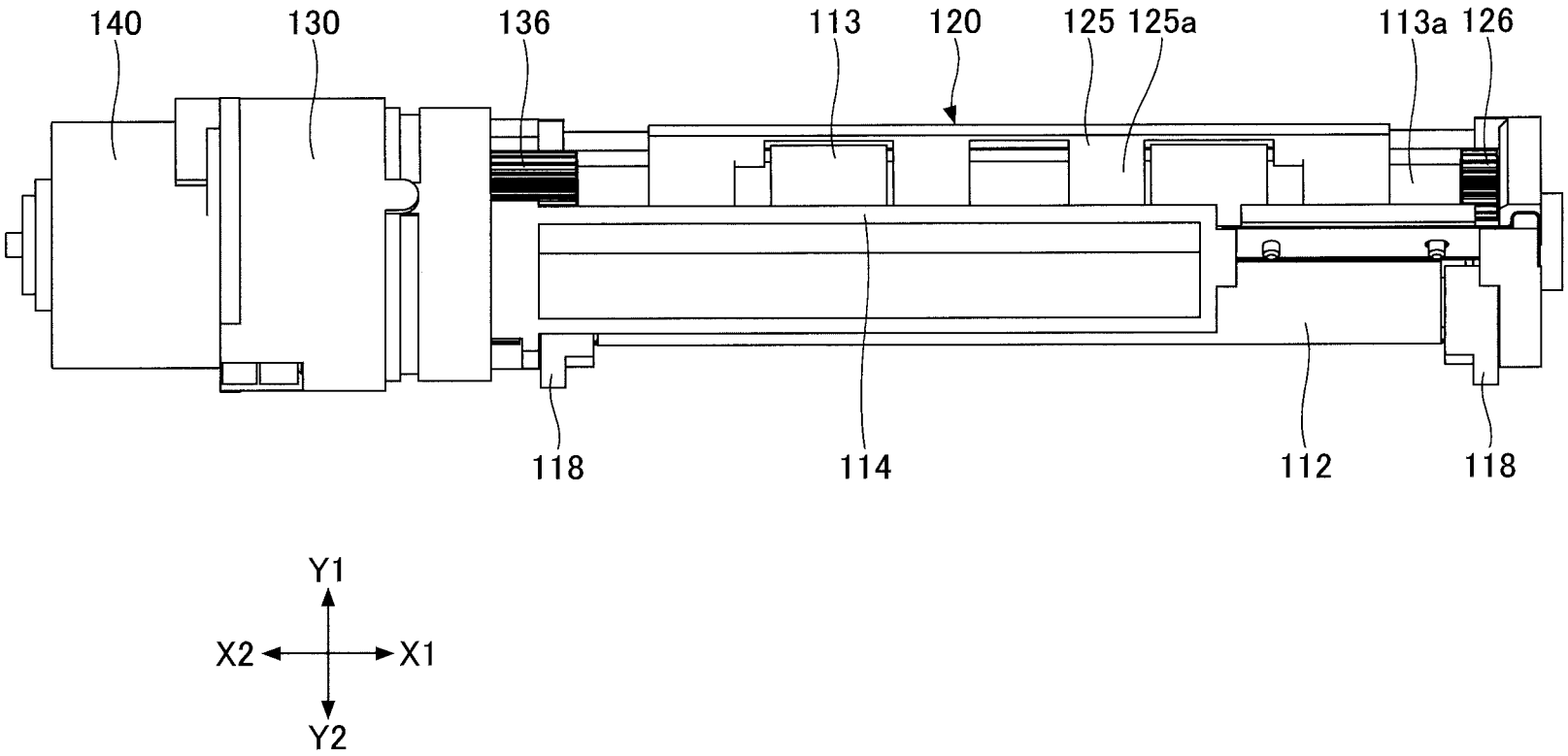
FIG. 6 is a bottom view of the printing mechanism according to the embodiment.
Figure 7:
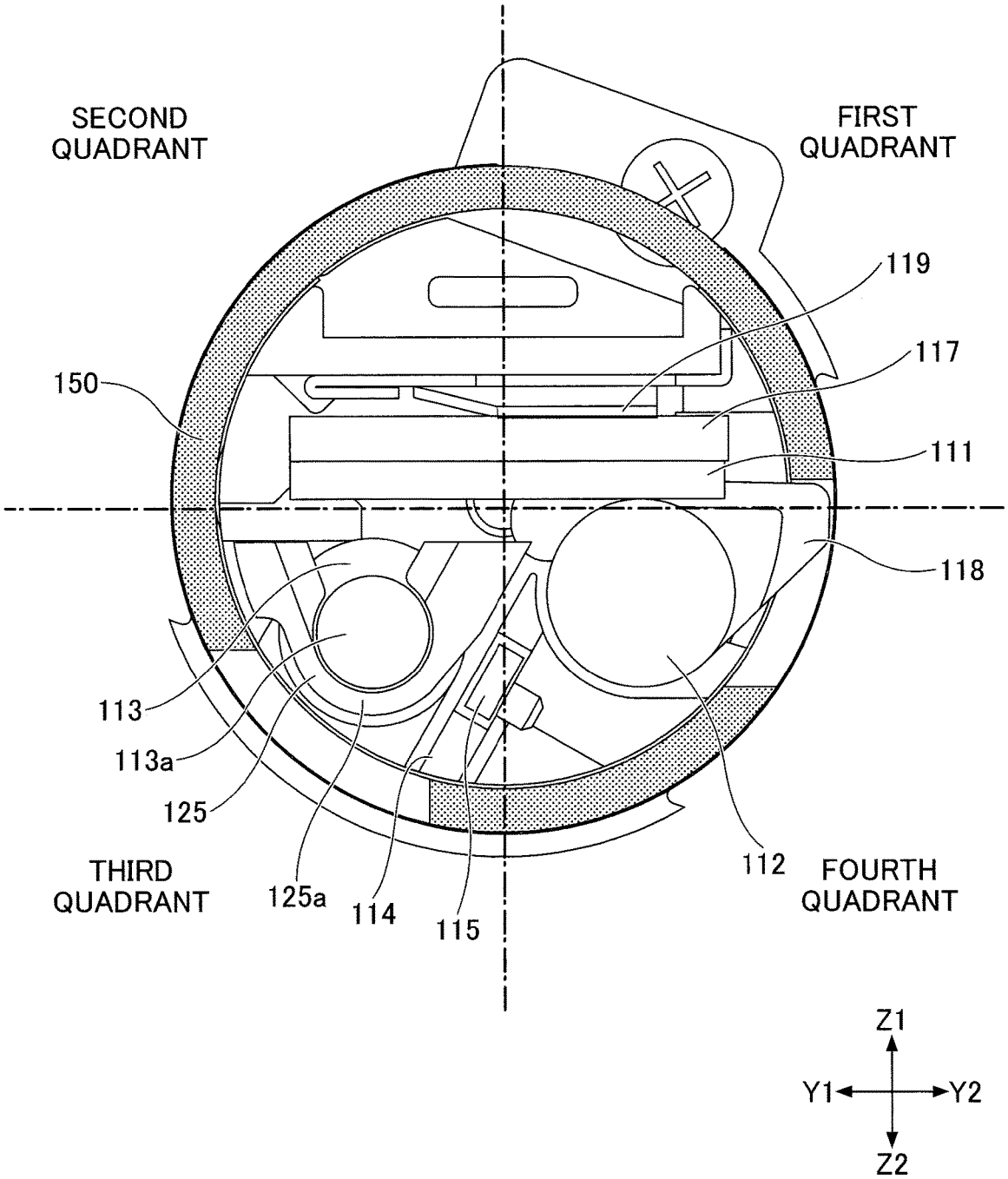
FIG. 7 is a cross-sectional view of the printing mechanism according to the embodiment.

The print unit 110 is described in more detail with reference to FIGS. 3 through 7. FIGS. 3 through 7 illustrate an internal structure of the print unit 110 with the inner cover 150 and the outer cover 160 being removed. FIG. 3 is a rear-side perspective view, FIG. 4 is a front-side perspective view, FIG. 5 is a top plan view, FIG. 6 is a bottom view, and FIG. 7 is a cross-sectional view of the print unit 110. In FIGS. 4 and 7, the illustration of the control board 116 and flexible printed circuits (FPCs) 122 through 124 is omitted.

The print unit 110 has a cylindrical shape elongated in the X direction. The printer 100 can be a pen type and easy to carry around, thus being small and highly portable. A printing mechanism 120, a gear box 130, and a motor 140 are aligned in the print unit 110, in order from the X1 side to the X2 side. According to this configuration, the rotation of the motor 140 is transmitted via gears in the gear box 130 to rotate the platen roller 112 and the feed roller 113. The platen roller 112 and the feed roller 113 are arranged in such a manner as to have their respective axes of rotation along the X direction, and the print head 111 is oriented such that a longitudinal direction of the print head 111 coincides with the X direction.

The printing mechanism 120 includes a housing 121 that accommodates various mechanisms. The print head 111, the platen roller 112, and the feed roller 113 are attached to the housing 121. Part of the housing 121 is formed into the paper guide 114 provided in a lower portion of the printer 100 in FIG. 2. The control board 116 is provided on the exterior of the housing 121 on its Z1 side. The FPC 122 is connected to a first connector provided at the X2 end of the control board 116. The FPC 122 extends in the X2 direction to be connected to terminals 141 provided near the motor 140. The FPC 123 is connected to a second connector provided at the X1 end of the control board 116. The FPC 123 extends from the second connector to be connected to a sensor 115 through a groove 121*a* provided in the exterior of the housing 121. The FPC 124 is connected to a third connector provided along the Y1-side edge of the control board 116. The FPC 124 extends from the third connector to be connected to the print head 111.

Figure 8:
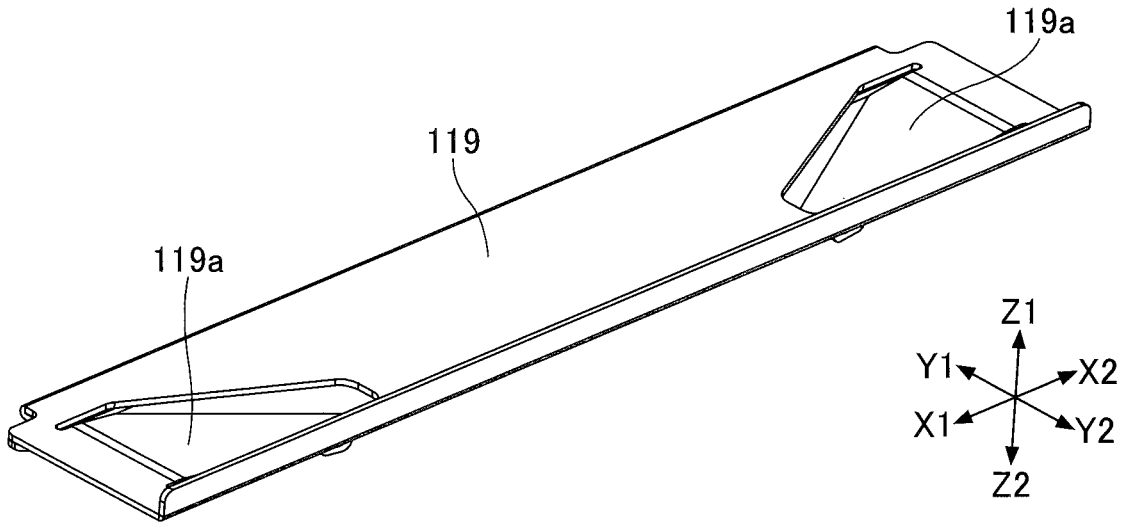
FIG. 8 is a perspective view of a spring.

Referring to FIG. 7, the printing mechanism 120 includes the spring 119 that presses the heat sink 117 attached to the print head 111 toward the platen roller 112. The print head 111 is pressed against the platen roller 112 via the heat sink 117 by the urging force of the spring 119. FIG. 8 is a perspective view of the spring 119. Referring to FIG. 8, the spring 119 has a plate shape elongated in the X direction. Cuts are formed one in each of an X1 end and an X2 end of the spring 119. Spring parts 119*a* of the spring 119 defined by the cuts are bent in the Z2 direction. When the spring 119 is attached to a desired position, the spring parts 119*a* deform to generate an urging force in a direction to press the heat sink 117.

Figure 9:
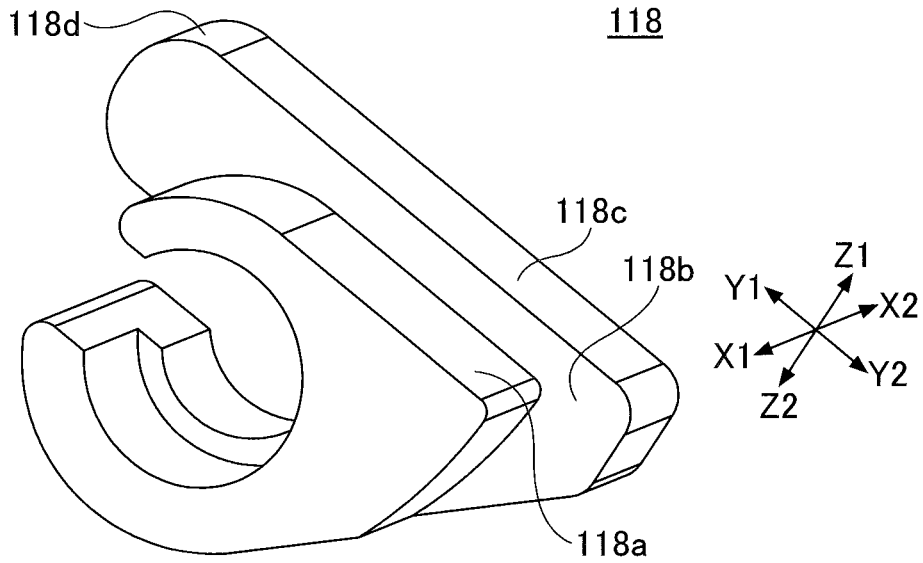
FIG. 9 is a perspective view of a guide claw.
Figure 10:
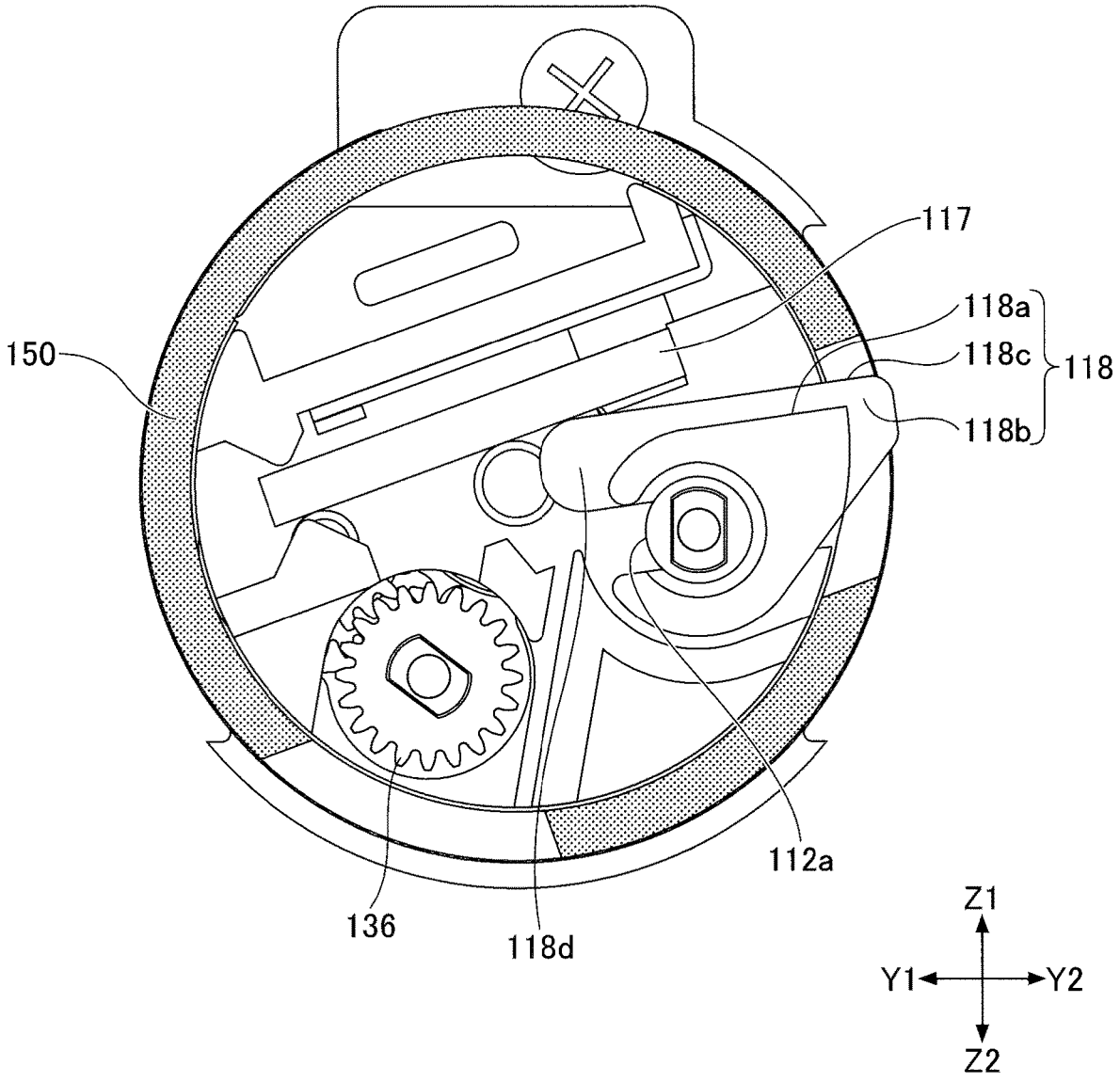
FIG. 10 is a diagram illustrating the guide claw.

Referring to FIGS. 4 and 5, guide claws 118 (hereinafter collectively referred to as "guide claw 118") are provided one at each longitudinal end of the platen roller 112. FIG. 9 is a perspective view of the guide claw 118. The guide claw 118 includes a first surface 118*a*, a side surface 118*b*, and a second surface 118*c*. The first surface 118*a* guides the bottom face of a recording sheet. The side surface 118*b* is on the outer side of the first surface 118*a* to guide one of the side edges of a recording sheet. The second surface 118*c* is on the outer side of the side surface 118*b*. The guide claw 118 is pivotably attached to a shaft 112*a* of the platen roller 112. The second surface 118*c* is in contact with the heat sink 117. When a recording sheet jams between the print head 111 and the platen roller 112, the guide claw 118 is pivoted clockwise to lift the heat sink 117 in the Z1 direction with a protrusion 118*d* provided on the Y1 side of the second surface 118*c* as illustrated in FIG. 10. Because the print head 111 is joined to the heat sink 117, the print head 111 is separated from the platen roller 112 and the jammed recording sheet is removed by lifting the heat sink 117 with the protrusion 118*d*.

Referring to FIG. 7, the sensor 115 that detects a recording sheet is provided on the X1 side of the paper guide 114. The sensor 115 is an optical reflective sensor. When a recording sheet is present, the light emitted from a light emitter of the sensor 115 is reflected from the recording sheet to enter a light receiver of the sensor 115, so that the presence of the recording sheet is detected. When no recording sheet is present, the emitted light does not enter the light receiver. Thus, the presence of a recording sheet can be determined by whether light is detected by the light receiver.

Referring to FIGS. 3 and 7, a paper guide 125 is provided on a shaft 113*a* of the feed roller 113. The paper guide 125 includes a clip 125*a*. The paper guide 125 is attached to the shaft 113*a* with the shaft 113*a* placed in and held by the clip 125*a*. A recording sheet entering from the feed side passes between the paper guide 114 and the paper guide 125 to be conveyed toward the nip between the print head 111 and the platen roller 112.

As illustrated in FIG. 7, for convenience, a cross section of the printing mechanism 120 in a YZ plane is divided into the first quadrant, the second quadrant, the third quadrant, and the fourth quadrant by two perpendicular lines crossing at the center of the cross section. Relative to the center of the cross section, the first quadrant is on the Y2 side and the Z1 side, the second quadrant is on the Y1 side and the Z1 side, the third quadrant is on the Y1 side and the Z2 side, and the fourth quadrant is on the Y2 side and the Z2 side. In this case, the print head 111 and the control board 116 are in the first quadrant and the second quadrant, the feed roller 113 is in the third quadrant, and the platen roller 112 is in the fourth quadrant. Because of this arrangement, the printing mechanism 120 can have a cylindrical shape elongated in the X direction and can be reduced in size.

Figure 11:
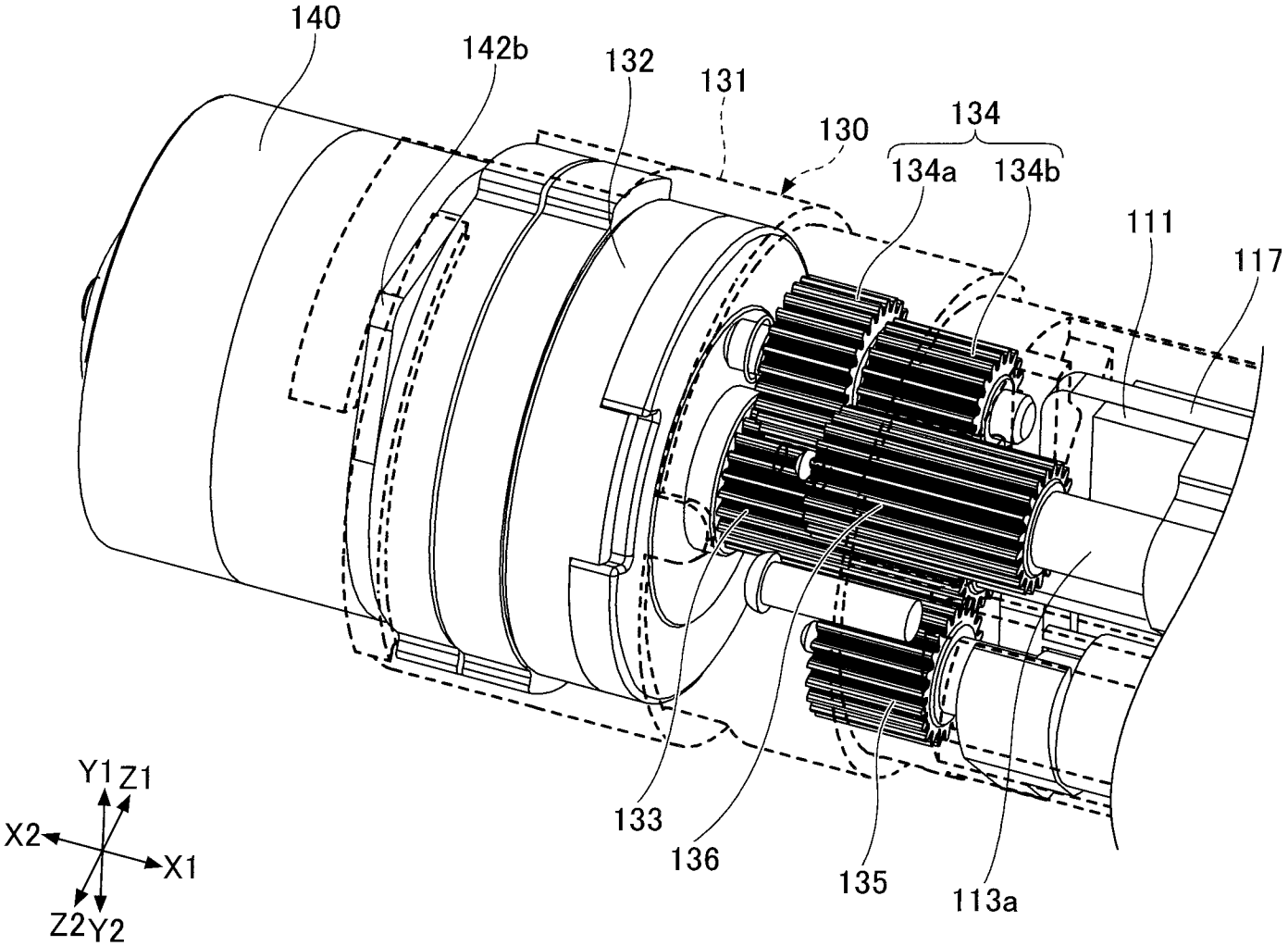
FIG. 11 is a partially phantom perspective view of the gear box according to the embodiment.
Figure 12:
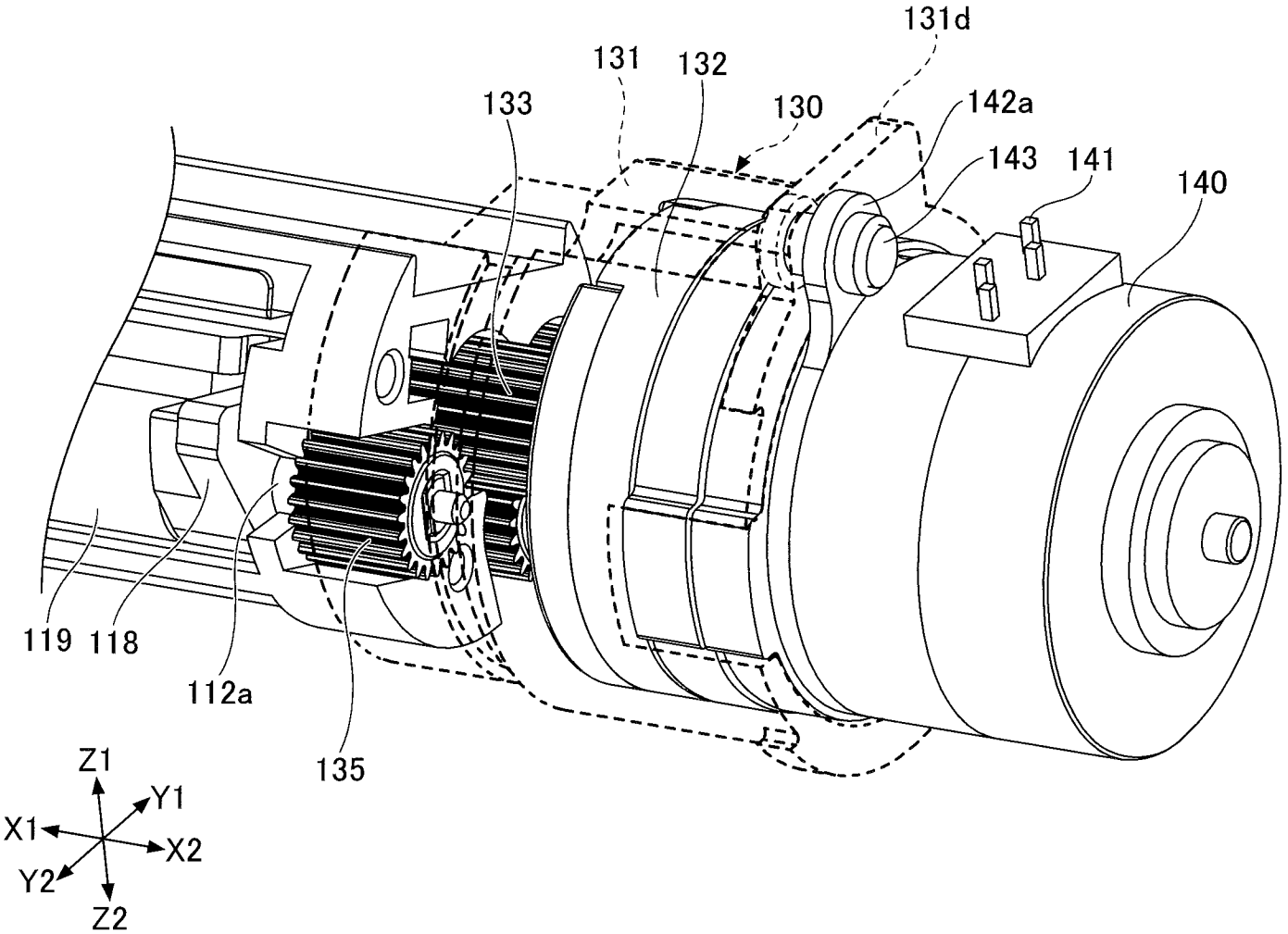
FIG. 12 is a partially phantom perspective view of the gear box according to the embodiment.
Figure 13:
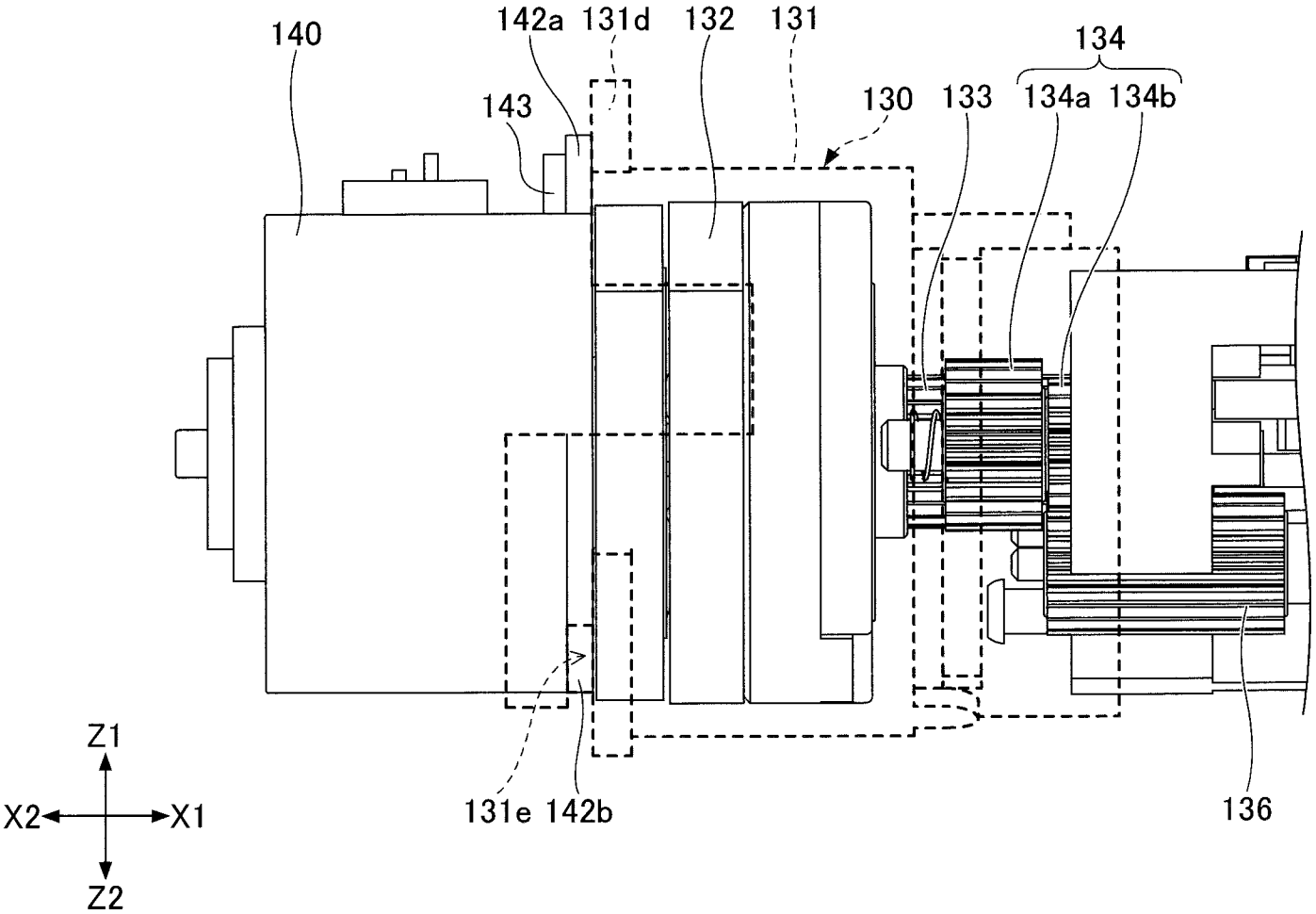
FIG. 13 is a partially phantom rear view of the gear box according to the embodiment.

The gear box 130 is described with reference to FIGS. 11 through 13. FIG. 11 is a rear-side partially phantom perspective view, FIG. 12 is a front-side partially phantom perspective view, and FIG. 13 is a partially phantom rear view of part of the housing in which the gear box 130 is provided.

Figure 14:
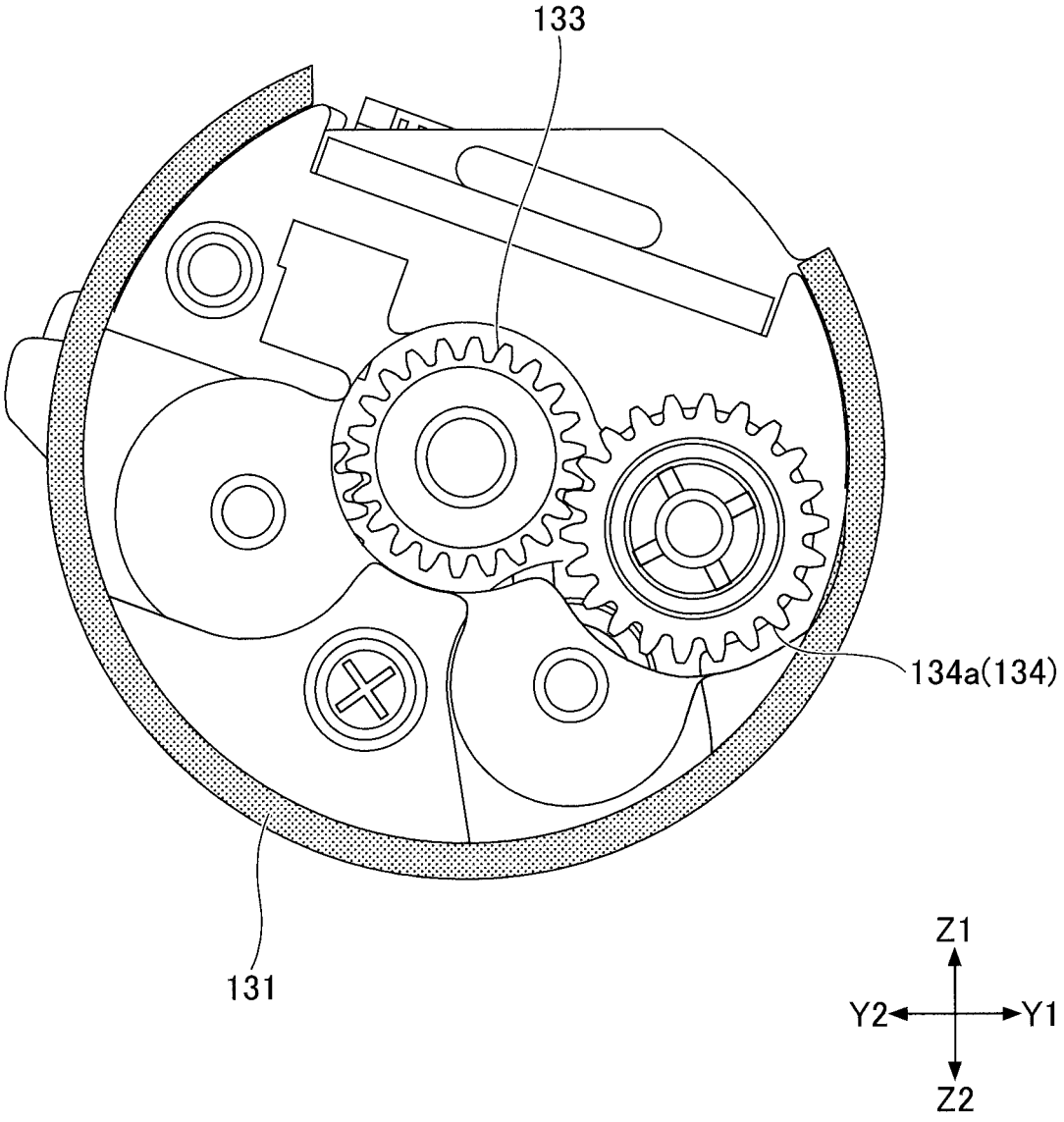
FIG. 14 is a cross-sectional view of the gear box according to the embodiment.
Figure 15:
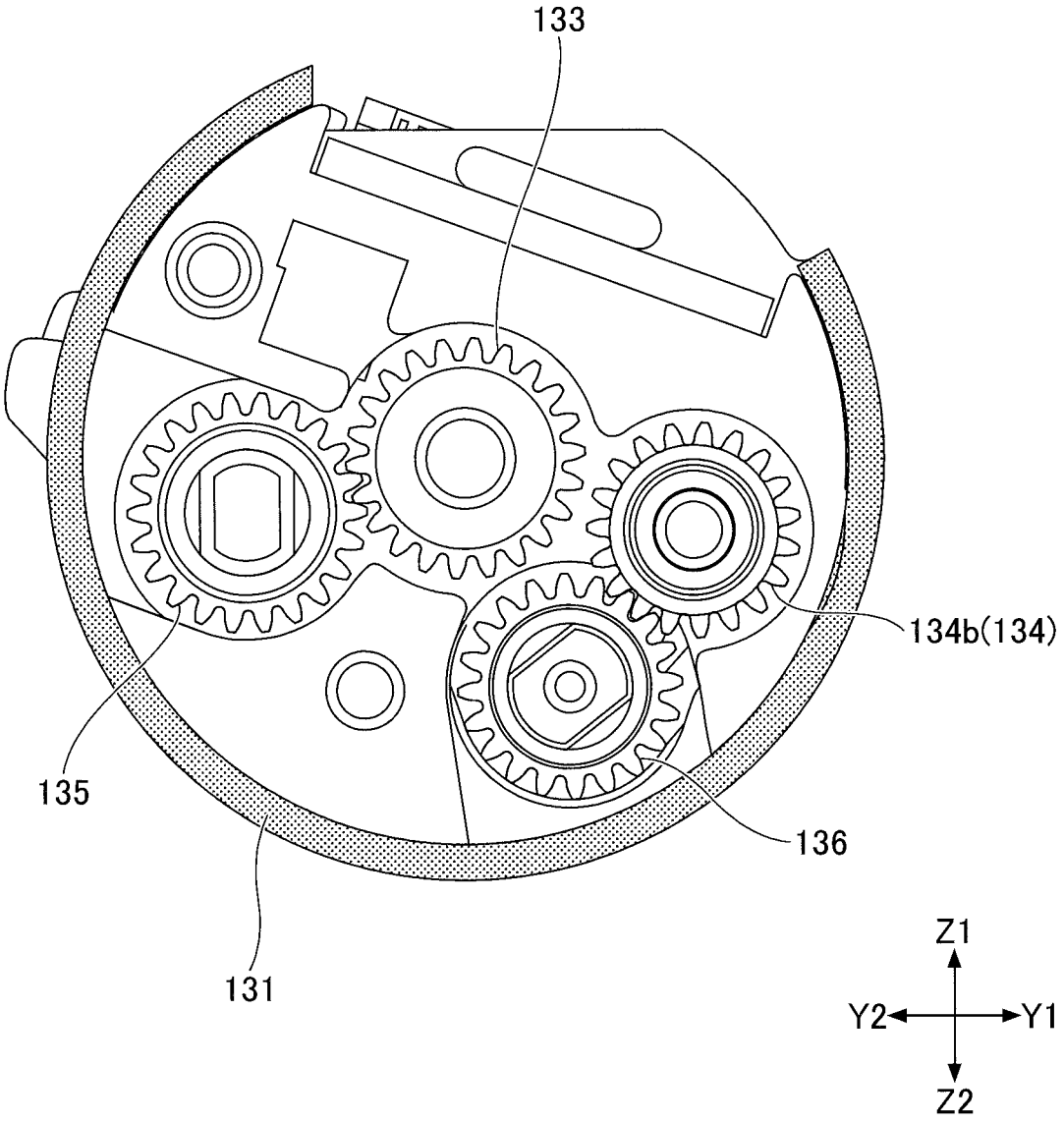
FIG. 15 is a cross-sectional view of the gear box according to the embodiment.

The gear box 130 is attached to the X1 side of the motor 140. The gear box 130 includes a gear box housing 131 ("housing 131") and a planetary gear 132 placed in the housing 131. The rotation of the motor 140 is transmitted to the gears of the planetary gear 132, and is output as the rotation of an output gear 133 attached to the X1 side of the planetary gear 132. Referring to FIGS. 14 and 15, the output gear 133 meshes with a connecting gear 134*a* of a one-way gear 134, and also meshes with a platen gear 135. FIG. 14 is a YZ-plane cross-sectional view of the gear box 130 in which the output gear 133 meshes with the connecting gear 134*a*. FIG. 15 is a YZ-plane cross-sectional view of the gear box 130 in which the output gear 133 meshes with the platen gear 135.

The platen gear 135 is attached to the X2 end of the shaft 112*a*. The rotation of the motor 140 is transmitted to the platen gear 135 via the planetary gear 132 and the output gear 133 to rotate the platen roller 112.

The rotational speed of the feed roller 113 is lower than the rotational speed of the platen roller 112. The one-way gear 134 that transmits rotation in only one direction is provided so that the rotation of the feed roller 113 follows the conveyance of a recording sheet by the platen roller 112 with the recording sheet conveyed with the platen roller 112 and the feed roller 113. Specifically, at the start of the conveyance of a recording sheet, the clockwise rotation of a drive gear 136 connected to the feed roller 113 increases, so that the counterclockwise rotation of an output gear 134*b* meshing with the drive gear 136 increases, and the one-way gear 134 is formed such that this counterclockwise rotation of the output gear 134*b* is faster than the rotation of the connecting gear 134*a*.

The one-way gear 134 includes the connecting gear 134*a* and the output gear 134*b* that are coaxially connected in the X direction. The output gear 134*b* is smaller in diameter and in the number of teeth than the connecting gear 134*a*. The output gear 134*b* meshes with the drive gear 136 attached to the X2 end of the shaft 113*a*. The rotation of the motor 140 is transmitted to the drive gear 136 via the planetary gear 132, the output gear 133, and the one-way gear 134 to rotate the feed roller 113. The one-way gear 134, in which the output gear 134*b* has a one-way function, is formed such that when the counterclockwise rotation of the output gear 134*b* increases, the output gear 134*b* is unlinked from the connecting gear 134*a* to be able to rotate counterclockwise faster than the connecting gear 134*a* rotates counterclockwise.

Figure 16:
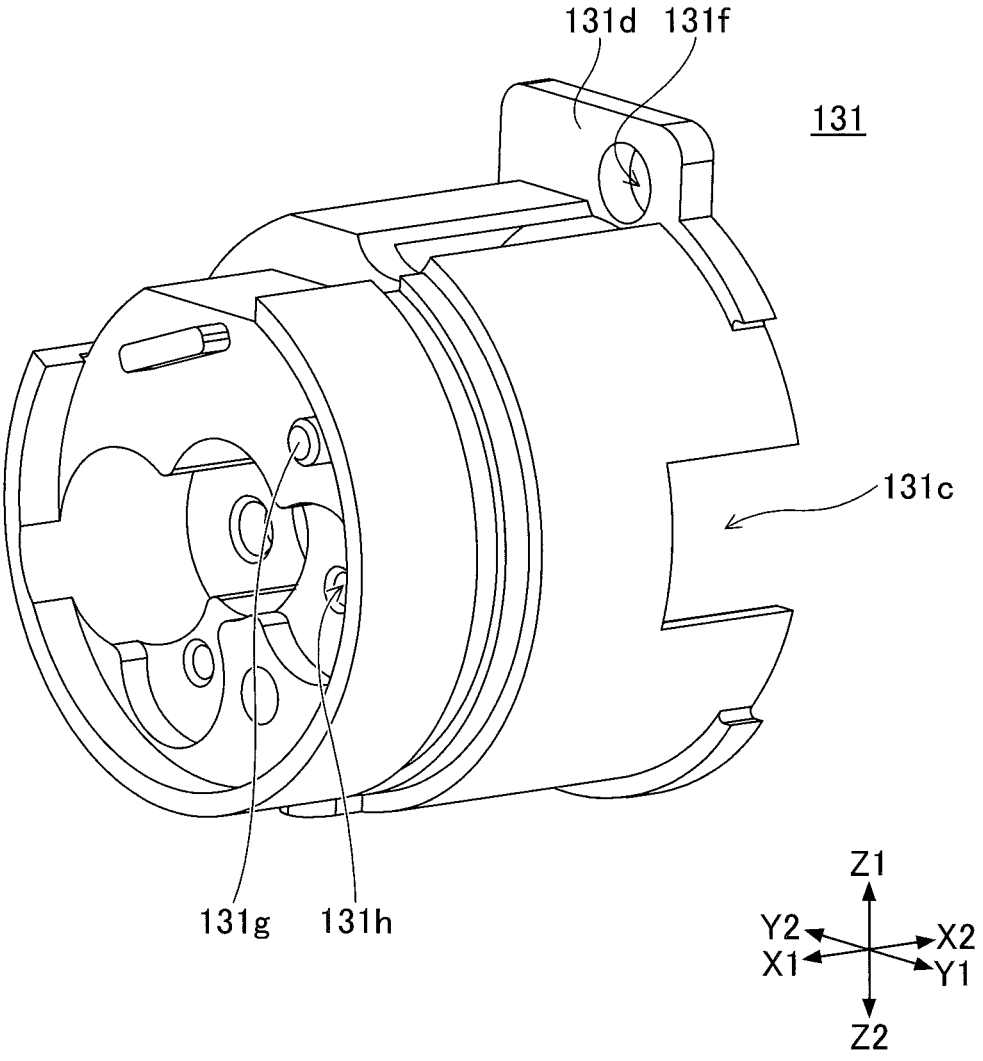
FIG. 16 is a perspective view of a gear box housing.
Figure 17:
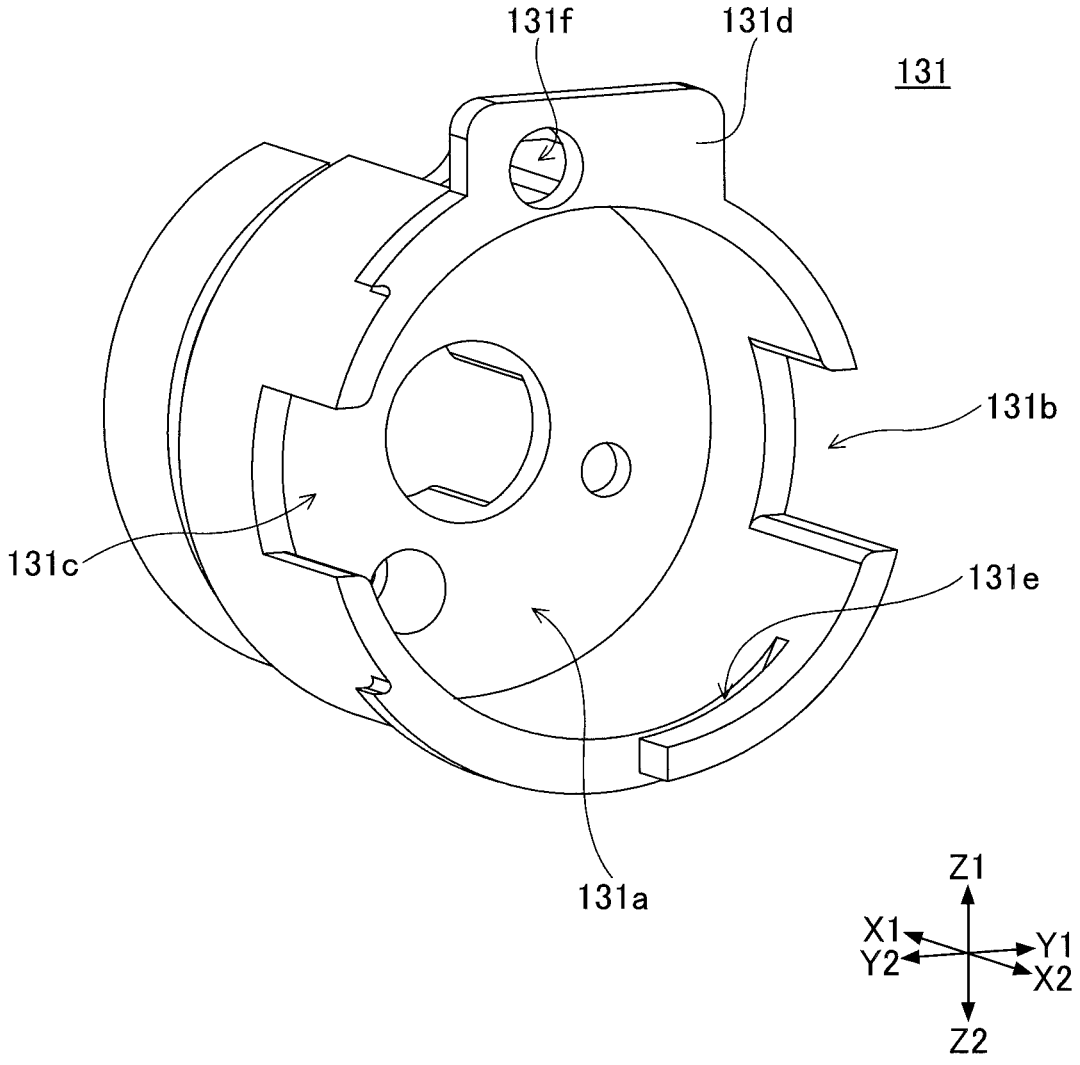
FIG. 17 is a perspective view of the gear box housing.

The gear box 130 and the printing mechanism 120 are connected via the housing 131. FIGS. 16 and 17 are an X1-side perspective view and an X2-side perspective view, respectively, of the housing 131. Referring to FIGS. 16 and 17, a recess 131*a* is provided at the X2 end of the housing 131 to accommodate the planetary gear 132. The rim of the recess 131*a* includes cuts 131*b* and 131*c* for fixing the planetary gear 132, a fixation part 131*d* for fixing the flange of the motor 140, and a fixation groove 131*e*. A screw hole 131*f* is formed in the fixation part 131*d*.

Figure 18:
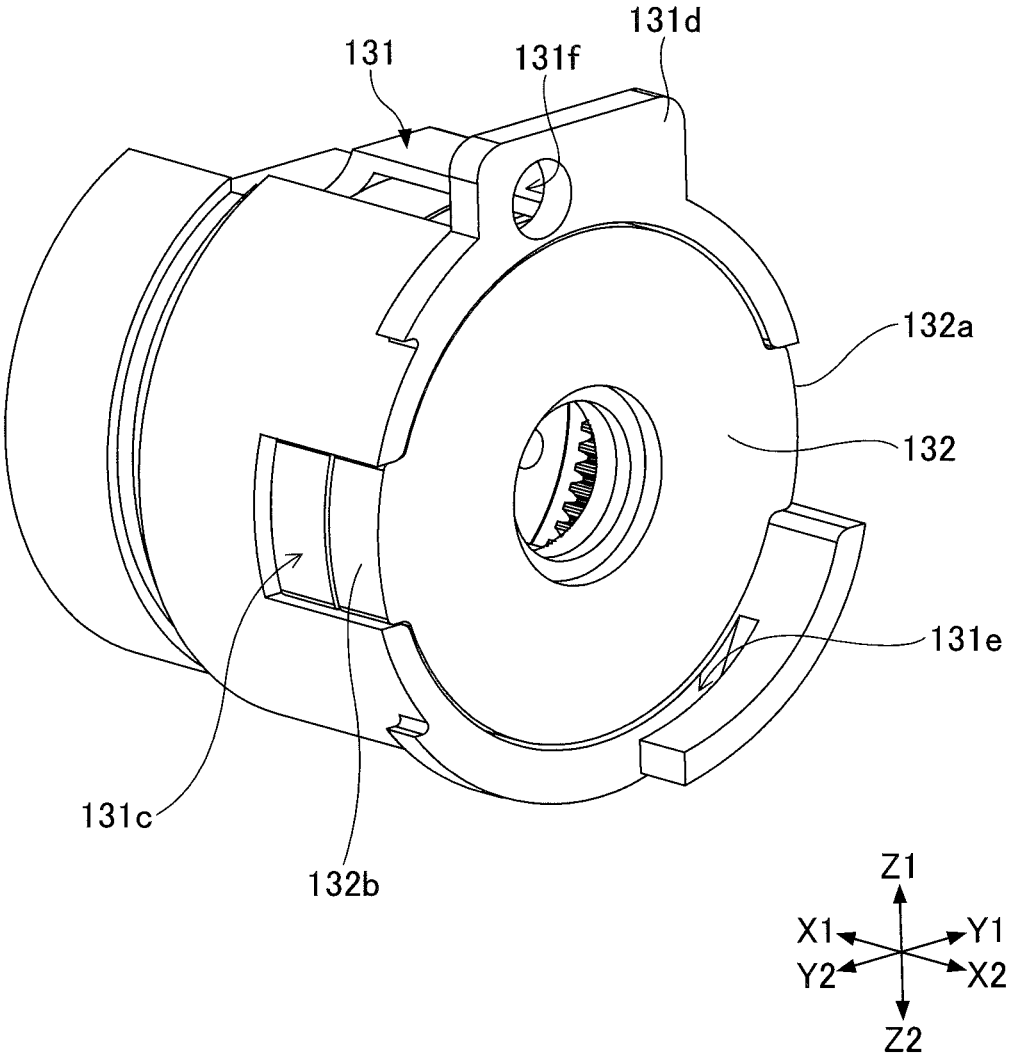
FIG. 18 is a diagram illustrating the gear box housing.

Referring to FIG. 18, protrusions 132*a* and 132*a* complementary in shape to the cuts 131*b* and 131*c* are provided on the planetary gear 132. By placing the protrusions 132*a* and 132*a* in the cuts 131*b* and 131*c*, respectively, the planetary gear 132 can be attached to the housing 131, being positioned relative to the housing 131.

The motor 140 is attached to the X2 side of the housing 131 to which the planetary gear 132 is attached. Referring to FIGS. 11 through 13, flanges 142*a* and 142*b* are provided at the X1 end of the motor 140 to protrude radially outward. A screw hole is formed in the flange 142*a*. The fixation groove 131*e* has such a width as to allow entry of the flange 142*b*.

To attach the motor 140 to the housing 131, the flange 142*b* is inserted into the fixation groove 131*e*, and a screw 143 is inserted into the screw hole 131*f* and the screw hole of the flange 142*a* to fasten the fixation part 131*d* and the flange 142*a* to fix the motor 140 to the X2 side of the housing 131.

Referring to FIG. 16, a pin 131*g* that positions the housing 131 is provided at the X1 end of the housing 131. The housing 131 is screwed to the housing 121 at its X2 end. A hole complementary in shape to the pin 131*g* is provided in the housing 121. In attaching the housing 131 to the housing 121, the pin 131*g* enters this hole to position the housing 131 relative to the housing 121 to prevent the rotation of the housing 131 relative to the housing 121.

The X2 end of the shaft 112*a* is rotatably supported in a support 131*h* of the housing 131. Furthermore, although not depicted, the X2 end of the shaft 113*a* is rotatably supported in a support of the housing 131.

Figure 19:
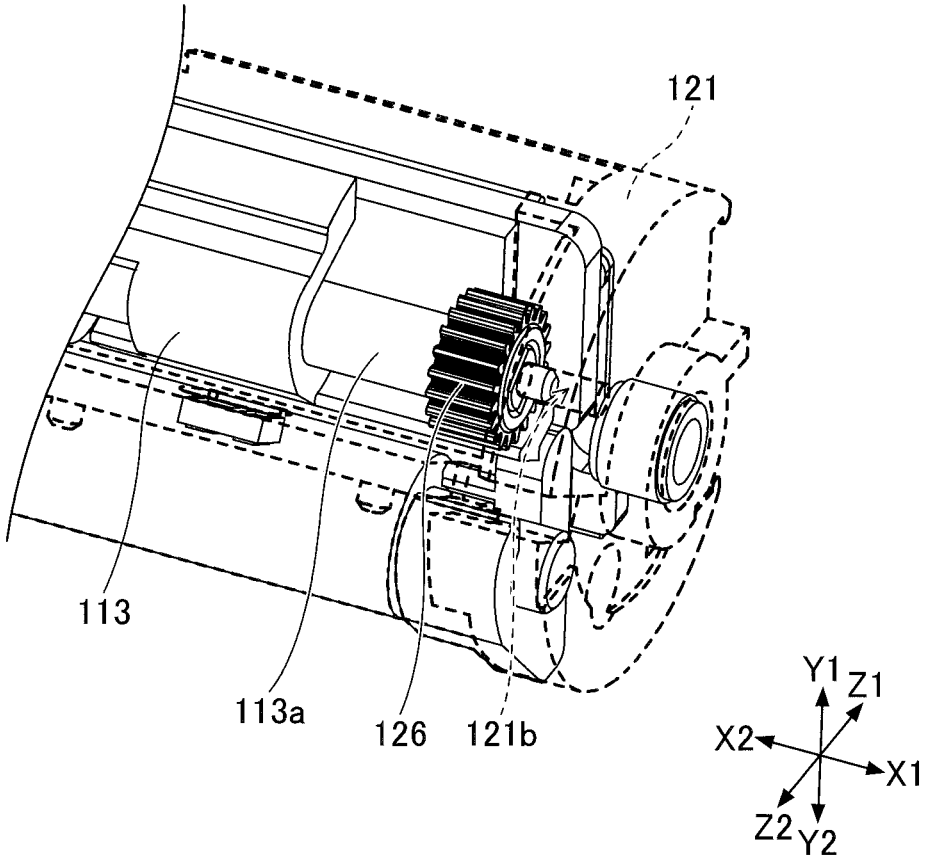
FIG. 19 is a partially phantom perspective view of the printing mechanism according to the embodiment.

Referring to FIG. 19, the X1 end of the shaft 113*a* is rotatably supported in a support 121*b* of the housing 121. Likewise, although not depicted, the X1 end of the shaft 112*a* is rotatably supported in a support of the housing 121.

Figure 20:
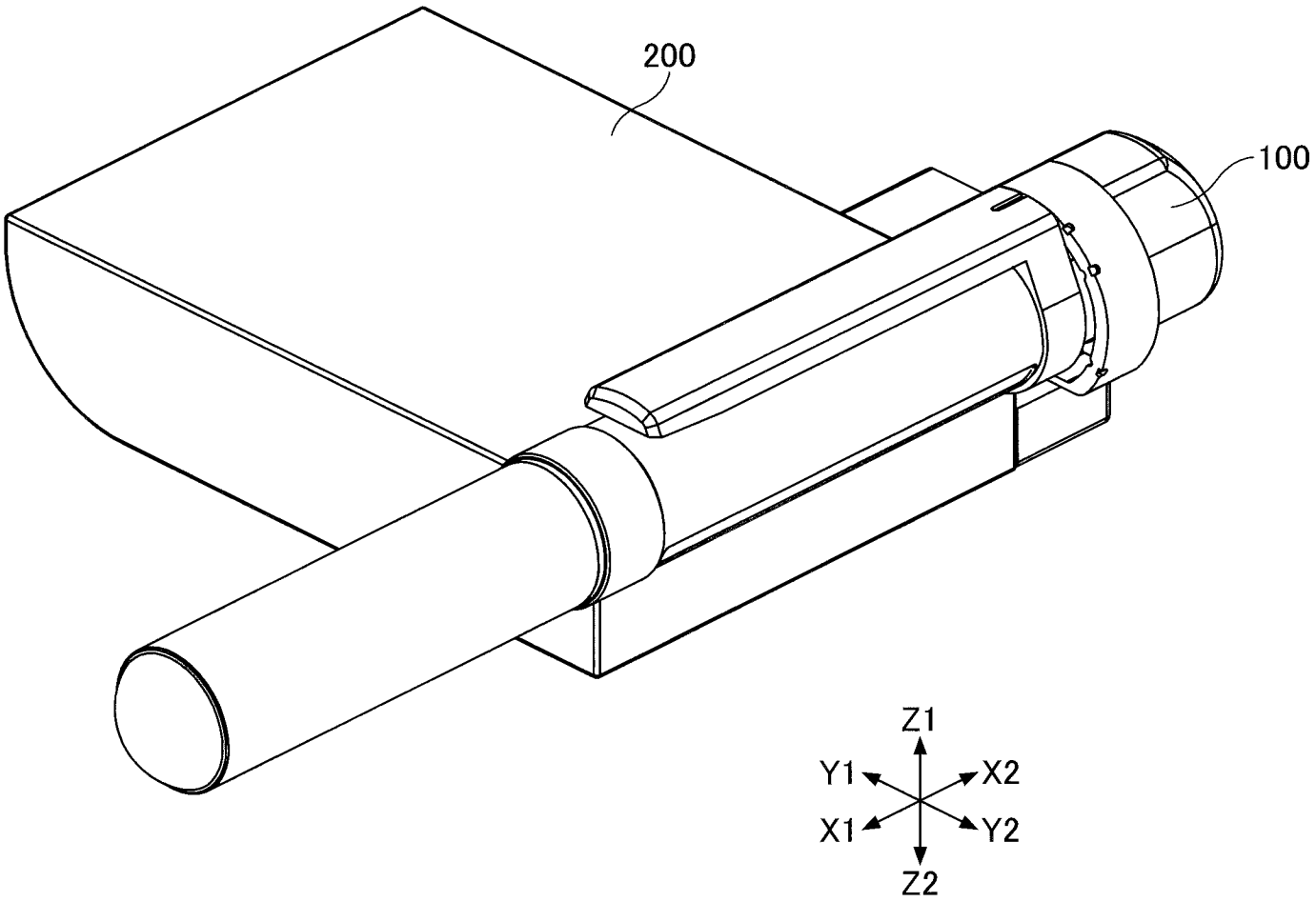
FIG. 20 is a perspective view of the printer and a sheet cassette that are connected.

Referring to FIG. 20, a cassette 200 that stores recording sheets can be attached to the printer 100. A feed roller is provided in the cassette 200, and a gear is attached to each end of the shaft of the feed roller. Referring to FIG. 6, a transmission gear 126 is provided at the X1 end of the shaft 113*a*, and the drive gear 136 is provided at the X2 end of the shaft 113*a*. With the cassette 200 attached to the printer 100, the transmission gear 126 and the drive gear 136 mesh with the gears of the cassette 200. Thus, the rotation of the feed roller 113 is transmitted to the gears of the cassette 200 via the transmission gear 126 and the drive gear 136 to rotate the feed roller in the cassette 200. The drive gear 136 operates as a gear to start moving the shaft 113*a* with the rotation of the one-way gear 134 and also operates as a transmission gear to transmit rotation to the gears of the cassette 200. Thus, a recording sheet stored in the cassette 200 can be fed into the printer 100 through the openings 151 and 161, and the fed recording sheet is conveyed toward the print head 111 by the feed roller 113.

All examples and conditional language provided herein are intended for pedagogical purposes of aiding the reader in understanding the invention and the concepts contributed by the inventors to further the art, and are not to be construed as limitations to such specifically recited examples and conditions, nor does the organization of such examples in the specification relate to a showing of the superiority or inferiority of the invention. Although one or more embodiments of the present invention have been described in detail, it should be understood that the various changes, substitutions, and alterations could be made hereto without departing from the spirit and scope of the invention.

What is claimed is:

1. A printing apparatus having a pillar shape, the printing apparatus comprising:

a printing mechanism including a print head configured to perform printing on a recording sheet;

a feed roller configured to convey the recording sheet toward the print head; and a platen roller configured to convey the recording sheet fed by the feed roller;

a motor; and a gear box configured to transmit a rotation of the motor to the feed roller and the platen roller, the gear box including an output gear configured to output the rotation of the motor;

a platen gear attached to the platen roller and meshing with the output gear to transmit the rotation of the motor output by the output gear to the platen roller;

a drive gear connected to the feed roller and configured to rotate the feed roller; and a one-way gear meshing with the output gear and the drive gear to transmit the rotation of the motor output by the output gear to the drive gear, wherein the printing mechanism, the gear box, and the motor are arranged in order from a first side of the printing apparatus toward a second side of the printing apparatus in a longitudinal direction of the printing apparatus.

2. The printing apparatus as claimed in claim 1, wherein the platen roller and the feed roller are arranged in such a manner as to have respective axes of rotation along the longitudinal direction of the printing apparatus, and a longitudinal direction of the print head coincides with the longitudinal direction of the printing apparatus.

3. The printing apparatus as claimed in claim 1, wherein in a case where a cross section of the printing mechanism perpendicular to the longitudinal direction is divided into a first quadrant, a second quadrant, a third quadrant, and a fourth quadrant with respect to a center of the cross section, the print head is in the first quadrant and the second quadrant, the platen roller is in the fourth quadrant, and the feed roller is in the third quadrant.

4. A printing apparatus having a pillar shape, the printing apparatus comprising:

a printing mechanism including a print head configured to perform printing on a recording sheet; and a platen roller configured to convey the recording sheet;

a motor; and guide claws configured to guide side edges of the recording sheet, the guide claws pivotably attached one to each of ends of a shaft of the platen roller, wherein each of the guide claws is configured to pivot to push up a heat sink attached to the print head with a part of the guide claw to separate the print head from the platen roller.

5. A printing apparatus having a pillar shape, the printing apparatus comprising:

a printing mechanism including a print head configured to perform printing on a recording sheet; and a platen roller configured to convey the recording sheet;

a motor including a first flange and a second flange each protruding radially outward; and a gear box configured to transmit a rotation of the motor to the platen roller, the gear box including a housing, the housing including a protrusion and a groove, wherein the motor is fixed to the gear box with the first flange contacting the protrusion and the second flange inserted into the groove.

6. The printing apparatus as claimed in claim 5, wherein the first flange and the protrusion are screwed together.

* * * * *